US009715987B2

(12) United States Patent
Xiao

(10) Patent No.: US 9,715,987 B2
(45) Date of Patent: Jul. 25, 2017

(54) SEMICONDUCTOR DEVICE AND RELATED MANUFACTURING METHOD

(71) Applicant: Semiconductor Manufacturing International (Shanghai) Corporation, Shanghai (CN)

(72) Inventor: Deyuan Xiao, Shanghai (CN)

(73) Assignee: Semiconductor Manufacturing International (Shanghai) Corporation (CN)

( * ) Notice: Subject to any disclaimer, the term of this patent is extended or adjusted under 35 U.S.C. 154(b) by 38 days.

(21) Appl. No.: 14/558,050

(22) Filed: Dec. 2, 2014

(65) Prior Publication Data

US 2015/0279607 A1 Oct. 1, 2015

(30) Foreign Application Priority Data

Apr. 1, 2014 (CN) ..... 2014 1 0129139

(51) Int. Cl.

| | |
|---|---|
| ***H01J 19/38*** | (2006.01) |
| ***H01J 9/24*** | (2006.01) |
| ***H01J 9/14*** | (2006.01) |
| ***H01J 21/06*** | (2006.01) |
| ***H01J 9/385*** | (2006.01) |

(52) U.S. Cl.

CPC ..... *H01J 21/06* (2013.01); *H01J 9/148* (2013.01); *H01J 9/24* (2013.01); *H01J 9/385* (2013.01); *H01J 19/38* (2013.01)

(58) Field of Classification Search

None

See application file for complete search history.

(56) References Cited

U.S. PATENT DOCUMENTS

| | | | | |
|---|---|---|---|---|
| 6,437,360 | B1 | 8/2002 | Cho et al. | |
| 7,274,051 | B2 * | 9/2007 | Kim | H01L 29/42384 257/210 |
| 8,932,916 | B2 * | 1/2015 | Lin | H01L 29/66969 257/E21.414 |
| 2006/0049429 | A1 * | 3/2006 | Kim | H01L 29/42384 257/213 |
| 2006/0216897 | A1 * | 9/2006 | Lee | B82Y 10/00 438/282 |

FOREIGN PATENT DOCUMENTS

WO 9949520 A1 9/1999

OTHER PUBLICATIONS

Jin-Woo Han et al., "Vacuum nanoelectronics: Back to the future?—Gate insulated nanoscale vacuum channel transistor", Appl. Phys. Lett. 100, 213505 (2012); doi: 10.1063/1.4717751, 5 pages.

* cited by examiner

*Primary Examiner* — Ashok Patel

(74) *Attorney, Agent, or Firm* — Innovation Counsel LLP

(57) ABSTRACT

A semiconductor device may include the following elements: a semiconductor substrate, an insulator positioned on the substrate, a source electrode positioned on the insulator, a drain electrode positioned on the insulator, a gate electrode positioned between the source electrode and the drain electrode, a hollow channel surrounded by the gate electrode and positioned between the source electrode and the drain electrode, a dielectric member positioned between the hollow channel and the gate electrode, a first insulating member positioned between the gate electrode and the source electrode, and a second insulating member positioned between the gate electrode and the drain electrode.

12 Claims, 15 Drawing Sheets

SEMICONDUCTOR DEVICE AND RELATED MANUFACTURING METHOD

CROSS-REFERENCE TO RELATED APPLICATION

This application claims priority to and benefit of Chinese Patent Application No. 201410129139.6, filed on 1 Apr. 2014, the Chinese Patent Application being incorporated herein by reference in its entirety.

BACKGROUND OF THE INVENTION

The present invention is related to a semiconductor device and a method for manufacturing the semiconductor device.

Semiconductor devices, such as vacuum field effect transistors (VFTs), may be used in place of vacuum tubes in various applications, such as one or more of stereo systems, microwave ovens, satellites, etc.

As an example, a vacuum field effect transistor (VFT) may include a source electrode, a drain electrode, a vacuum channel positioned between the source and the drain electrode, a gate electrode positioned under the source electrode and the drain electrode, an insulator that insulates the gate electrode from the source electrode and the drain electrode, and a substrate for supporting at least the gate electrode and the insulator. As another example, a VFT may include a source electrode that has a hollow structure, a gate electrode positioned under the source electrode, a first insulator that insulates the gate electrode from the source electrode, a second insulator disposed on the source electrode and surrounding a vacuum channel, a drain electrode positioned above the vacuum channel, and a substrate that supports at least the gate electrode and the first insulator.

In operating a VFT, a suitable bias may be applied to the gate electrode and/or to a position between the source electrode and the drain electrode to enable electrons to be transmitted from the source electrode through the vacuum channel to the drain electrode. In general, the distribution of the electric field in the vacuum channel may be substantially asymmetric. As a result, transmission of electrons may not be sufficiently controlled, such that the on and off of the VFT may not be effectively and timely controlled. For achieving desirable control of the VFT, additional voltage may be required, such that the operation of the VFT may require substantially high energy consumption.

SUMMARY

An embodiment of the present invention may be related to a semiconductor device that may include the following elements: a semiconductor substrate, an insulator positioned on the substrate, a source electrode positioned on the insulator, a drain electrode positioned on the insulator, a gate electrode positioned between the source electrode and the drain electrode, a hollow channel surrounded by the gate electrode and positioned between the source electrode and the drain electrode, a dielectric member positioned between the hollow channel and the gate electrode, a first insulating member positioned between the gate electrode and the source electrode; and a second insulating member positioned between the gate electrode and the drain electrode.

The semiconductor device may include a first sidewall and a second sidewall. A portion of the first sidewall may be positioned between the first insulating member and the source electrode. A portion of the second sidewall may be positioned between the second insulating member and the drain electrode.

At least one of the first sidewall and the second sidewall may be formed of a low work function material.

The low work function material may be or may include at least one of Zr, V, Nb, Ta, Cr, Mo, W, Fe, Co, Pd, Cu, Al, Ga, In, Ti, TiN, TaN, and diamond.

At least one of the first sidewall and the second sidewall may have a curved surface that is convex toward and/or disposed inside the hollow channel.

At least one of the gate electrode, the source electrode, and the drain electrode may be formed of at least one of Cr, W, Co, Pd, Cu, Al, Ti, TiN, Ta, TaN, Au, Ag, and Pt.

The hollow channel may contain an inert gas or a substantially vacuum space.

The hollow channel may have at least one of a circular cylindrical structure, an oval cylindrical structure, a circular frustum structure, an oval frustum structure, a circular cone structure.

A thickness of the dielectric member may be in a range of 1 nm to 10 nm.

An embodiment of the present invention may be related to a method for manufacturing a semiconductor device. The method may include the following steps: preparing a substrate structure that includes a semiconductor substrate and an insulating layer; forming a sacrificial layer on the insulating layer; using the sacrificial layer to form a wire (e.g., a nanowire); forming a dielectric member that surrounds the wire; forming a gate electrode that surrounds the dielectric member; removing the wire for forming a hollow channel that is surrounded by the gate electrode; forming a first insulating member and a second insulating member; forming a source electrode such that the first insulating member is positioned between the gate electrode and the source electrode; and forming a drain electrode such that the second insulating member is positioned between the gate electrode and the drain electrode.

The method may include the following steps: removing two portions of a dielectric layer that are located at two ends of the gate electrode for forming the dielectric member; and removing two portions of the sacrificial layer that are located at the two ends of the gate electrode for forming the wire.

The method may include the following steps: forming a first sidewall at the first insulating member before the step of forming the source electrode; and forming a second sidewall at the second insulating member before the step of forming the drain electrode. A portion of the first sidewall may be positioned between the first insulating member and the source electrode after the step of forming the source electrode. A portion of the second sidewall may be positioned between the second insulating member and the drain electrode after the step of forming the drain electrode At least one of the first sidewall and the second sidewall may be formed of a low work function material.

At least one of the first sidewall and the second sidewall may include a curved surface that is convex toward the hollow channel.

The method may include performing annealing using an atmosphere that includes at least one of $H_2$ and $N_2$ such that at least one of the first sidewall and the second sidewall may include a curved surface that is convex toward and/or positioned inside the hollow channel. The annealing may be performed at a temperature that is in a range of 600° C. to 1300° C.

The method may include providing an inert gas in the hollow channel and/or evacuating the hollow channel.

The hollow channel may have at least one of a circular cylindrical structure, an oval cylindrical structure, a circular frustum structure, an oval frustum structure, a circular cone structure.

The method may include the following steps: patterning the sacrificial layer and the insulating layer to form a fin structure that includes a portion of the sacrificial layer and a portion of the insulating layer, wherein the portion of the insulating layer may directly contact the portion of the sacrificial layer; removing the portion of the insulating layer; and performing annealing on the portion of the sacrificial layer to form the wire. The portion of the sacrificial layer may have a substantially rectangular cross-section. The wire may have a substantially circular or oval cross-section. The annealing may be performed using an atmosphere that includes at least one of He, $N_2$, Ar, and $H_2$.

The step of removing the portion of the insulating layer may include etching the portion of the insulating layer using at least one of a buffered oxide etch solution and a diluted hydrofluoric acid solution.

The sacrificial layer may be formed of at least one of Al, polycrystalline silicon, Cr, Mo, W, Fe, Co, Cu, Ga, In, and Ti.

A thickness of the dielectric member may be in a range of 1 nm to 10 nm.

According to embodiments of the present invention, an electric field between the source electrode and the drain electrode may be substantially surrounded and/or enclosed by the gate electrode. Therefore, the on and off of an electron flow between the source electrode and the drain electrode may be substantially effectively controlled, and energy may be efficiently utilized. Advantageously, controllability of the semiconductor device may be satisfactory, and energy consumption of the semiconductor device may be minimized.

The above summary is related to one or more of many embodiments of the invention disclosed herein and is not intended to limit the scope of the invention.

DETAILED DESCRIPTION

Figure 1A:
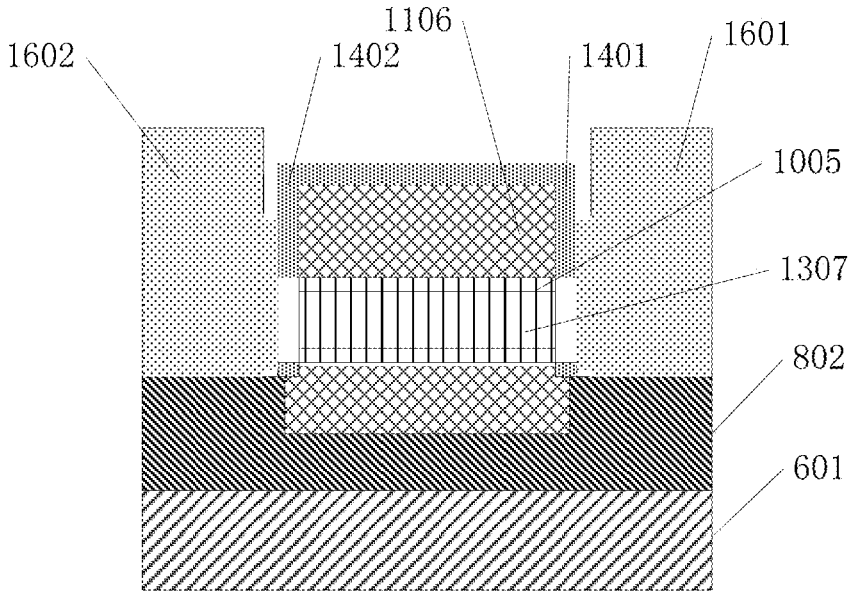
FIG. 1A shows a schematic cross-sectional view that illustrates a cross-section of a semiconductor device viewed in a direction perpendicular to an extension direction of a hollow channel in accordance with an embodiment of the present invention.

Example embodiments of the present invention are described with reference to the accompanying drawings. As those skilled in the art would realize, the described embodiments may be modified in various different ways, all without departing from the spirit or scope of the present invention. Embodiments of the present invention may be practiced without some or all of these specific details. Well known process steps and/or structures may not have been described in detail in order to not unnecessarily obscure the present invention.

The drawings and description are illustrative and not restrictive. Like reference numerals may designate like (e.g., analogous or identical) elements in the specification. Repetition of description may be avoided.

The relative sizes and thicknesses of elements shown in the drawings are for facilitate description and understanding, without limiting the present invention. In the drawings, the thicknesses of some layers, films, panels, regions, etc., may be exaggerated for clarity.

Illustrations of example embodiments in the figures may represent idealized illustrations. Variations from the shapes illustrated in the illustrations, as a result of, for example, manufacturing techniques and/or tolerances, may be possible. Thus, the example embodiments should not be construed as limited to the shapes or regions illustrated herein but are to include deviations in the shapes. For example, an etched region illustrated as a rectangle may have rounded or curved features. The shapes and regions illustrated in the figures are illustrative and should not limit the scope of the example embodiments.

Although the terms "first", "second", etc. may be used herein to describe various elements, these elements, should not be limited by these terms. These terms may be used to distinguish one element from another element. Thus, a first element discussed below may be termed a second element without departing from the teachings of the present invention. The description of an element as a "first" element may not require or imply the presence of a second element or other elements. The terms "first", "second", etc. may also be used herein to differentiate different categories or sets of elements. For conciseness, the terms "first", "second", etc. may represent "first-category (or first-set)", "second-category (or second-set)", etc., respectively.

If a first element (such as a layer, film, region, or substrate) is referred to as being "on", "neighboring", "connected to", or "coupled with" a second element, then the first element can be directly on, directly neighboring, directly connected to, or directly coupled with the second element, or an intervening element may also be present between the first element and the second element. If a first element is referred to as being "directly on", "directly neighboring", "directly connected to", or "directed coupled with" a second element, then no intended intervening element (except environmental elements such as air) may also be present between the first element and the second element.

Spatially relative terms, such as "beneath", "below", "lower", "above", "upper", and the like, may be used herein for ease of description to describe one element or feature's spatial relationship to another element(s) or feature(s) as illustrated in the figures. It will be understood that the spatially relative terms may encompass different orientations of the device in use or operation in addition to the orientation depicted in the figures. For example, if the device in the figures is turned over, elements described as "below" or "beneath" other elements or features would then be oriented "above" the other elements or features. Thus, the term "below" can encompass both an orientation of above and below. The device may be otherwise oriented (rotated 90 degrees or at other orientations), and the spatially relative descriptors used herein should be interpreted accordingly.

The terminology used herein is for the purpose of describing particular embodiments and is not intended to limit the invention. As used herein, the singular forms, "a", "an", and "the" may indicate plural forms as well, unless the context clearly indicates otherwise. The terms "includes" and/or "including", when used in this specification, may specify the presence of stated features, integers, steps, operations, elements, and/or components, but may not preclude the presence or addition of one or more other features, integers, steps, operations, elements, components, and/or groups.

Unless otherwise defined, terms (including technical and scientific terms) used herein have the same meanings as commonly understood by one of ordinary skill in the art related to this invention. Terms, such as those defined in commonly used dictionaries, should be interpreted as having meanings that are consistent with their meanings in the context of the relevant art and should not be interpreted in an idealized or overly formal sense unless expressly so defined herein.

The term "connect" may mean "electrically connect". The term "conduct" may mean "electrically conduct". The term "insulate" may mean "electrically insulate".

Unless explicitly described to the contrary, the word "comprise" and variations such as "comprises", "comprising", "include", or "including" may imply the inclusion of stated elements but not the exclusion of other elements.

Various embodiments, including methods and techniques, are described in this disclosure. Embodiments of the invention may also cover an article of manufacture that includes a non-transitory computer readable medium on which computer-readable instructions for carrying out embodiments of the inventive technique are stored. The computer readable medium may include, for example, semiconductor, magnetic, opto-magnetic, optical, or other forms of computer readable medium for storing computer readable code. Further, the invention may also cover apparatuses for practicing embodiments of the invention. Such apparatus may include circuits, dedicated and/or programmable, to carry out operations pertaining to embodiments of the invention. Examples of such apparatus include a general purpose computer and/or a dedicated computing device when appropriately programmed and may include a combination of a computer/computing device and dedicated/programmable hardware circuits (such as electrical, mechanical, and/or optical circuits) adapted for the various operations pertaining to embodiments of the invention.

Figure 1B:
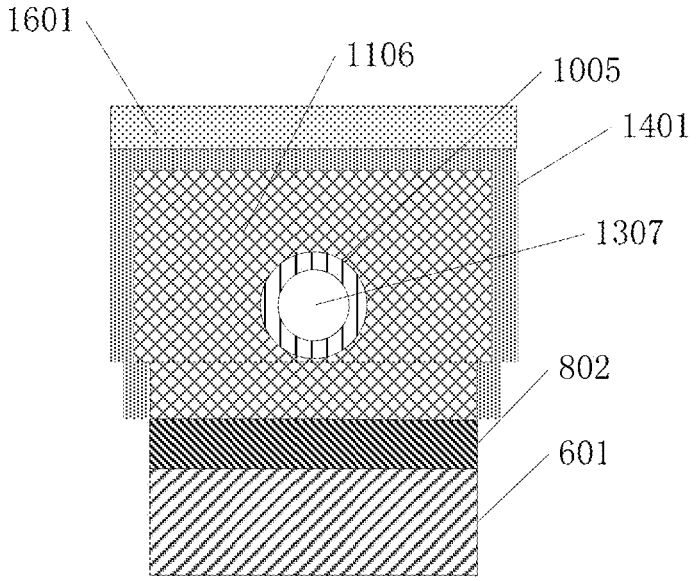
FIG. 1B shows a schematic cross-sectional view that illustrates a cross-section of a semiconductor device viewed in an extension direction of a hollow channel in accordance with an embodiment of the present invention.

FIG. 1A shows a schematic cross-sectional view that illustrates a cross-section of a semiconductor device viewed in a direction perpendicular to an extension direction of a hollow channel 1307 in accordance with an embodiment of the present invention. FIG. 1B shows a schematic cross-sectional view that illustrates a cross-section of the semiconductor device viewed in the extension direction of the hollow channel 1307 in accordance with an embodiment of the present invention.

As illustrated in FIG. 1A and FIG. 1B, the semiconductor may include one or more of the following elements and/or structures: a semiconductor substrate 601, a gate electrode 1106 (or gate 1106 for conciseness) positioned on the insulator 802, a source electrode 1601 (or source 1601 for conciseness) positioned on the insulator 802, a drain electrode 1602 (or drain 1602 for conciseness) positioned on the insulator 802, an insulator 802 positioned on the substrate 601 and positioned between the source 1601 and the drain 1602, a hollow channel 1307 (e.g., a vacuum channel structure) substantially completely surrounded by the gate 1106 and positioned between the source 1601 and the drain 1602, a dielectric member 1005 positioned between the hollow channel 1307 and the gate 1106, a first insulating member 1401 positioned between the gate 1106 and the source 1601, and a second insulating member 1602 positioned between the gate 1106 and the drain 1602.

In the semiconductor device, a portion of the gate 1106 may be positioned between two portions of the insulator 802. A portion of the gate 1106 may be positioned the first insulating member 1401 and the second insulating member 1402. The dielectric member 1105 may substantially completely surround the hollow channel 1307 and may be substantially completely surrounded by the gate 1106. If the element 1602 is a source electrode, then the element 1601 may be a drain electrode.

An operation of the semiconductor device may include one or more of the following steps: applying a negative voltage to the source 1601 to generate escaping electrons that may enter the hollow channel 1307, applying a positive voltage to the drain 1602 to form an electric field between the source 1601 and the drain 1602 for enabling the electrons to travel from the source 1601 toward the drain 1602, and applying a positive voltage to the gate 1106. If the positive voltage applied to the gate 1106 is less than a threshold voltage, the electrons may need to tunnel through a barrier that has a substantially large width in order to enter the hollow channel 1307 and/or to reach the drain 1602; as a result, the electrons may not be able travel from the source 1601 to the drain 1602, such that the semiconductor device may function as an insulator and/or may be in an "off" state. If the positive voltage applied to the gate 1106 is greater than the threshold voltage, the electrons may tunnel through a barrier that has a substantially small width, may enter the hollow channel 1307, and may reach the drain 1602; as a result, the electrons may able travel from the source 1601 to the drain 1602, such that the semiconductor device may function as a conductor and/or may be in an "on" state. The threshold value may be obtained through experiments and/or tests.

In embodiments, the electric field between the source 1601 and the drain 1602 may be substantially surrounded and/or enclosed by the gate 1106. Therefore, the on and off of the electron flow may be substantially effectively controlled, and energy may be efficiently utilized. Advantageously, controllability of the semiconductor device may be satisfactory, and energy consumption of the semiconductor device may be minimized.

In an embodiment, one or more inert gases may be provided in the hollow channel 1307. For example, helium (He) may be provided in the hollow channel 1307.

In an embodiment, the hollow channel 1307 may contain a substantially vacuum space. The substantially vacuum space in the hollow channel 1307 may facilitate transmission of electrons. The substantially vacuum space in the hollow channel 1307 may be implemented by placing the hollow channel 1307 or a semiconductor device structure with the hollow channel 1307 in a sealed chamber and then extracting air and/or gases from the hollow channel 1307 using one or more of a molecular pump, a mechanical pump, etc.

In an embodiment, the pressure inside the hollow channel 1307 may be in a range of 0.001 torr to 50 torr. This range may be consistent with a related physical vapor deposition (PVD) process pressure setting.

A conventional tube may require maintaining a substantially low pressure (i.e., substantial vacuum), for preventing collision between electrons and gas molecules inside the tube. In a conventional tube, an electric field may cause positive ions generated from the residual gas to accelerate and bombard the cathode, such that damage may be incurred.

In an embodiment of the invention, dimensions of a vacuum transistor may be substantially smaller than the mean free path of electrons, and the working voltage may be sufficiently low, such that generation of unwanted positive ions may be prevented, and such that the vacuum transistor may be functional and durable at an atmospheric pressure.

In an embodiment, the pressure inside the hollow channel may be substantially equal to an atmospheric pressure.

The hollow channel 1307 may have one or more of a circular cylindrical structure, an oval cylindrical structure, a circular frustum structure, an oval frustum structure, a circular cone structure, etc. Cross-sections of the hollow channel 1307 viewed in an extension direction of the hollow channel 1307 (and/or in a source-to-drain electron transmission direction) may have one or more of a circular shape, an oval shape, etc., and may have one or more sizes.

The distance between the source 1601 and the drain 1602 may be in a range of several nanometers to several hundred nanometers. The distance may be less than 10 nm. The distance may be less than a mean free path of electrons in the air. The smaller the distance, the lower the chance of unwanted collision. At the same time, a sufficient distance may be configured for feasible and robust processing of the semiconductor device structure. The electron mean free path may be related to a voltage between the source 1601 and the drain 1602 and/or may be related to a pressure inside the hollow channel 1307. In an embodiment, the electron mean free path may be in the order of 1 cm.

The thickness of the dielectric member 105 may be in a range of 1 nm to 10 nm. The dielectric member 105 is sufficient thin such that desirable control may be achieved with a low supply voltage. At the same time, a sufficient thickness of the dielectric member 105 may be configured for feasible and robust processing of the semiconductor device structure.

Figure 2A:
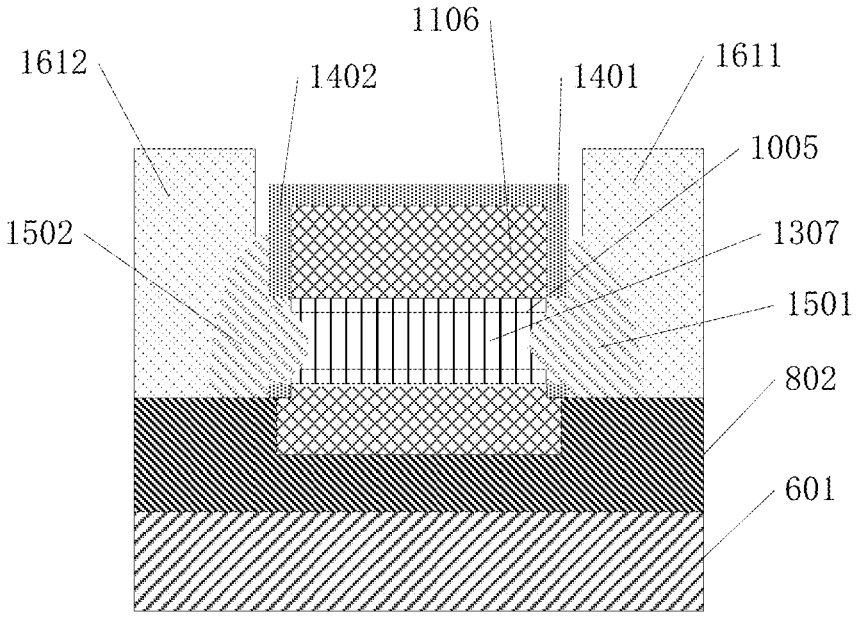
FIG. 2A shows a schematic cross-sectional view that illustrates a cross-section of a semiconductor device viewed in a direction perpendicular to an extension direction of a hollow channel in accordance with an embodiment of the present invention.
Figure 2B:
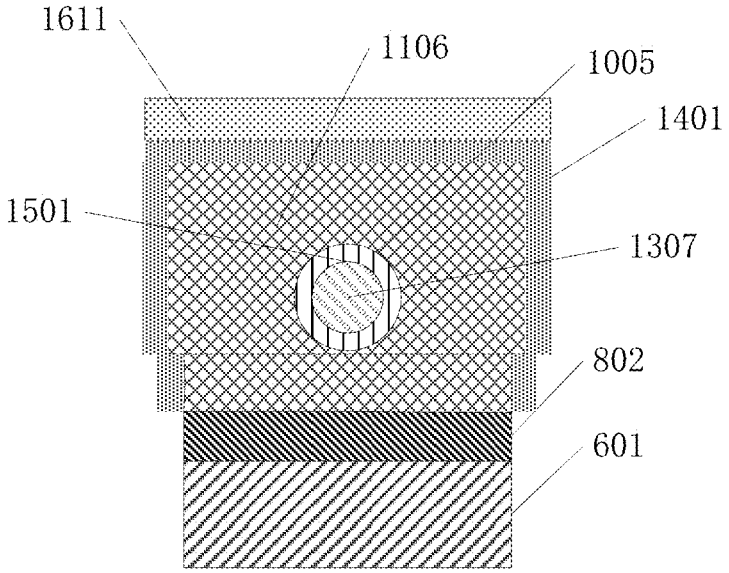
FIG. 2B shows a schematic cross-sectional view that illustrates a cross-section of a semiconductor device viewed in an extension direction of a hollow channel in accordance with an embodiment of the present invention.
Figure 17A:
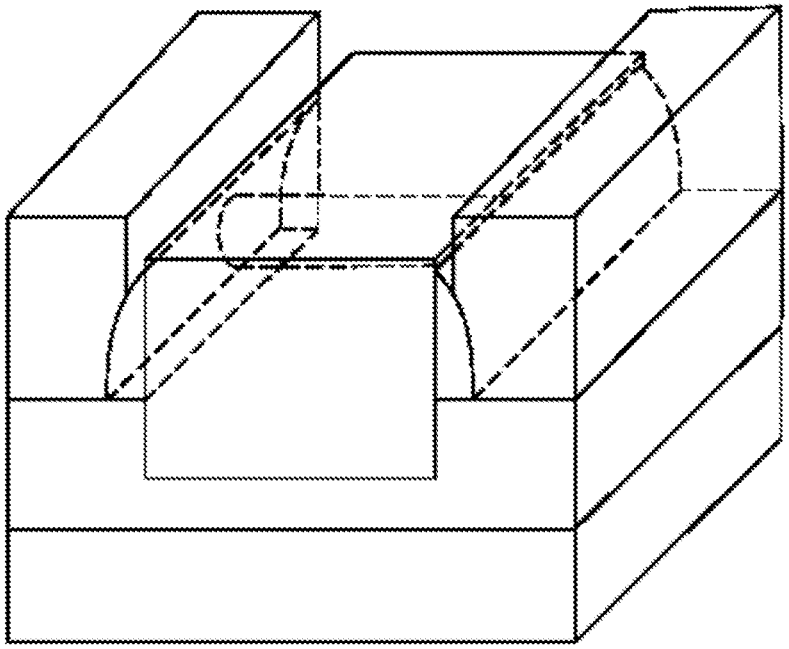
FIG. 17A shows a schematic perspective view that illustrates a semiconductor device in accordance with an embodiment of the present invention.
Figure 17B:
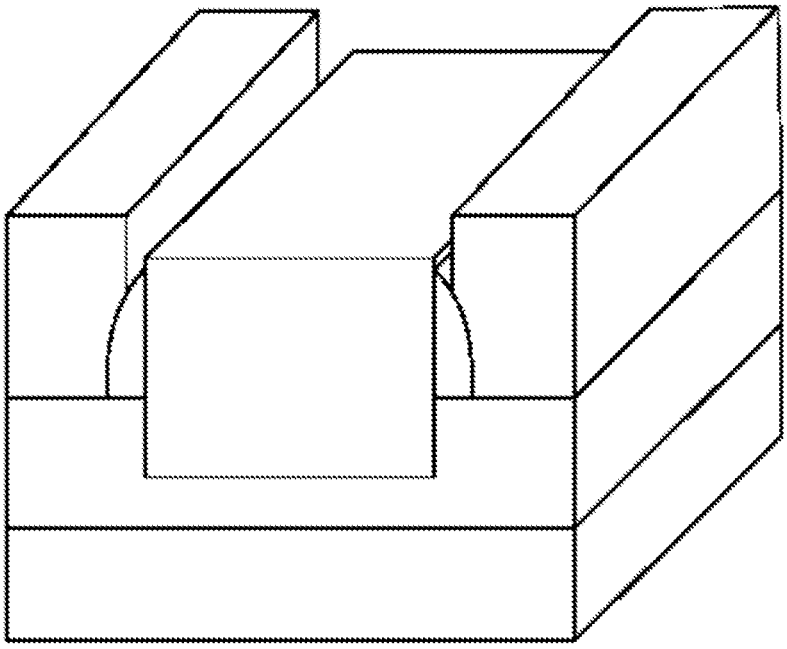
FIG. 17B shows a schematic perspective view that illustrates a semiconductor device in accordance with an embodiment of the present invention.

FIG. 2A shows a schematic cross-sectional view that illustrates a cross-section of a semiconductor device viewed in a direction perpendicular to an extension direction of a hollow channel 1307 in accordance with an embodiment of the present invention. FIG. 2B shows a schematic cross-sectional view that illustrates a cross-section of the semiconductor device viewed in an extension direction of the hollow channel 1307 in accordance with an embodiment of the present invention. FIG. 17A shows a schematic perspective view that illustrates the semiconductor device in accordance with an embodiment of the present invention. FIG. 17B shows a schematic perspective view that illustrates the semiconductor device in accordance with an embodiment of the present invention. A schematic perspective view of an internal structure of the semiconductor device according to an embodiment is illustrated in FIG. 17A.

The semiconductor device illustrated in FIG. 2A, FIG. 2B, FIG. 17A, and FIG. 17B may include one or more elements and/or structures that may be analogous to or substantially identical to one or more elements and/or structures of the semiconductor device discussed with reference to FIG. 1A and FIG. 1B.

The semiconductor device illustrated in FIG. 2A, FIG. 2B, FIG. 17A, and FIG. 17B may further include a first sidewall 1501 (or first spacer 1501) and a second sidewall 1502 (or second spacer 1502). The first sidewall 1501 may be positioned between a first insulating member 1401 and a source electrode 1611 (or source 1611). The second sidewall 1502 may be positioned between a second insulating member 1402 and a drain electrode 1612 (or drain 1612).

At least one of the first sidewall 1501 and the second sidewall 1502 may be made of a low work function material, which may facilitate transmission and reception of electrons. The work function of the low work function material may be less than 6 eV. The low work function material may include at least one of Zr (zirconium), V (vanadium), Nb (niobium), Ta (tantalum), Cr (chromium), Mo (molybdenum), W (tungsten), Fe (iron), Co (cobalt), Pd (palladium), Cu (copper), Al (aluminum), Ga (gallium), In (indium), Ti (titanium), TiN (titanium nitride), TaN (tantalum nitride), diamond, etc.

At least one of the first sidewall 1501 and the second sidewall 1502 may have a curved surface (e.g., an arcuate surface) that may be convex toward the hollow channel 1307 and/or positioned inside the hollow channel 1307. The curved surface may minimize potential acute angle effects to prevent the source 1611 from being burned. The curved surface(s) may provide a substantially large electron transmission area and/or a substantially large electron reception area, such that the effectiveness and/or efficiency of the semiconductor device may be maximized.

One or more of the source 1601, the source 1611, the drain 1602, the drain 1612, and the gate 1106 may be made of at least one of Cr, W, Co, Pd, Cu, Al, Ti, TiN, Ta, TaN, Au (gold), Ag (silver), Pt (platinum), etc.

Figure 3:
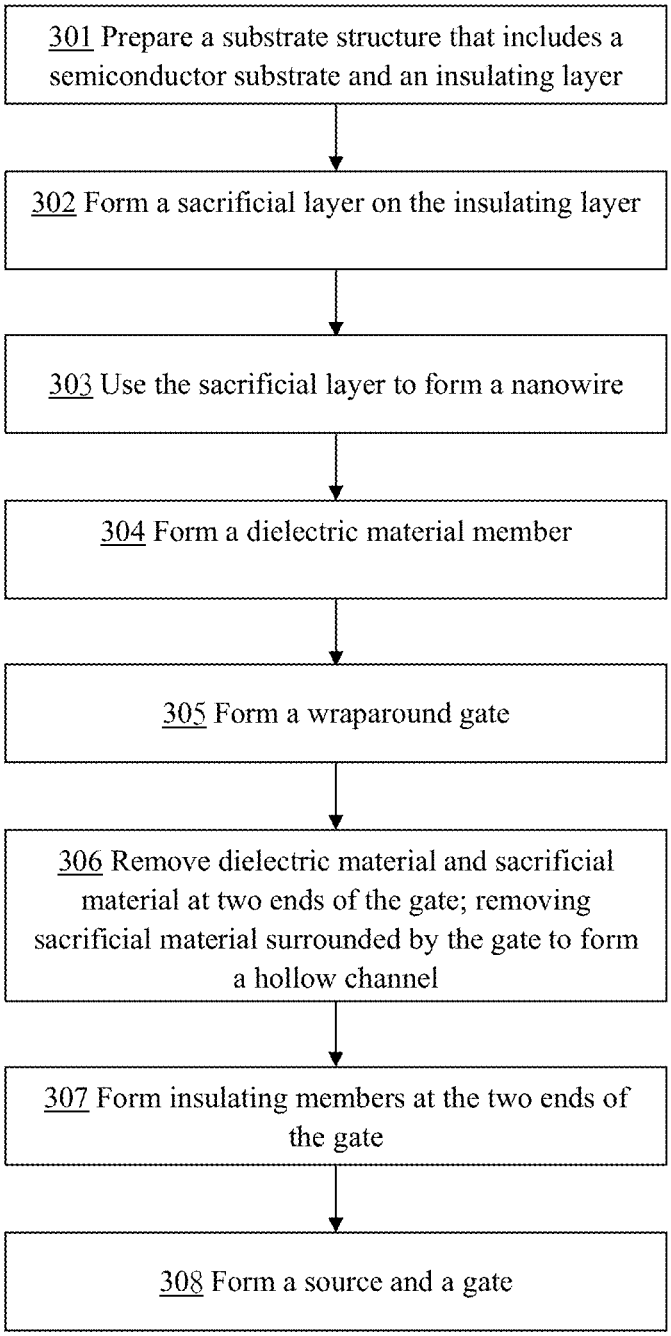
FIG. 3 shows a flowchart that illustrates a method for manufacturing a semiconductor device in accordance with an embodiment of the present invention.

FIG. 3 shows a flowchart that illustrates a method for manufacturing a semiconductor device in accordance with an embodiment of the present invention. Schematic cross-section views illustrating intermediate structures related to process steps in the method are shown in subsequent figures.

Figure 6A:
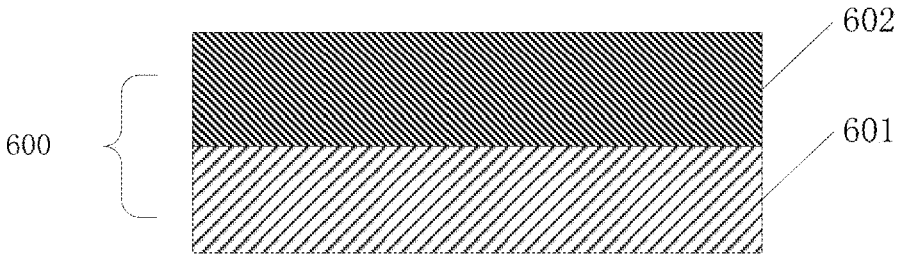
FIG. 6A shows a schematic cross-sectional view that illustrates a substrate structure in accordance with an embodiment of the present invention.

FIG. 6A shows a schematic cross-sectional view that illustrates substrate structure 600 in accordance with an embodiment of the present invention. Referring to FIG. 3 and FIG. 6A, the method may include a step 301, preparing the substrate 600, which may include a semiconductor substrate 601 and an insulating material layer 602 (or insulating layer 602) formed on the semiconductor substrate 601. The semiconductor substrate 601 may be formed and/or may include silicon (Si). The insulating material layer 602 may be formed and/or may include silicon dioxide ($SiO_2$). The insulating material layer 602 may be formed on the semiconductor substrate through one or more deposition methods, such as one or more of one or more of PVD (physical vapor deposition), CVD (chemical vapor deposition), ALD (atomic layer deposition), etc.

Figure 6B:
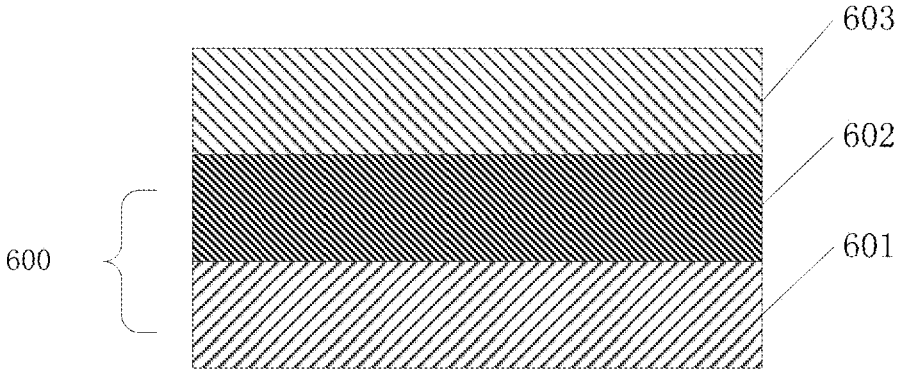
FIG. 6B shows a cross-sectional view that illustrates a semiconductor device manufacturing intermediate structure in accordance with an embodiment of the present invention.

FIG. 6B shows a cross-sectional view that illustrates a semiconductor device manufacturing intermediate structure in accordance with an embodiment of the present invention. Referring to FIG. 3 and FIG. 6B, the method may include a step 302, forming (e.g., depositing) a sacrificial layer 603 on the insulating material layer 602. The sacrificial layer 603 may be formed through one or more of PVD, CVD, etc. The PVD may include one or more of electron beam evaporation, magnetron sputtering, etc. and may be associated with a relatively lower cost.

A thickness of the sacrificial layer 603 may be in a range of several nanometers to several tens of nanometers. According particular embodiments, a thickness of the sacrificial layer 603 may be less than or greater than this range.

The on, the sacrificial layer 603 may be made of and/or may include at least one of the following materials: Al, polycrystalline silicon), Cr, Mo, W, Fe, Co, Cu, Ga, In, Ti, etc.

Referring to FIG. 3, in method may include step 303, using the sacrificial layer 603 to form a nanowire. The nanowire may be formed through etching the sacrificial layer 603. The nanowire may have one or more of a circular cylindrical structure, an oval cylindrical structure, a circular frustum structure, an oval frustum structure, a circular cone structure, etc. Cross-sections of the nanowire viewed in an extension direction of the nanowire may have one or more of a circular shape, an oval shape, etc., and may have one or more sizes.

Figure 5:
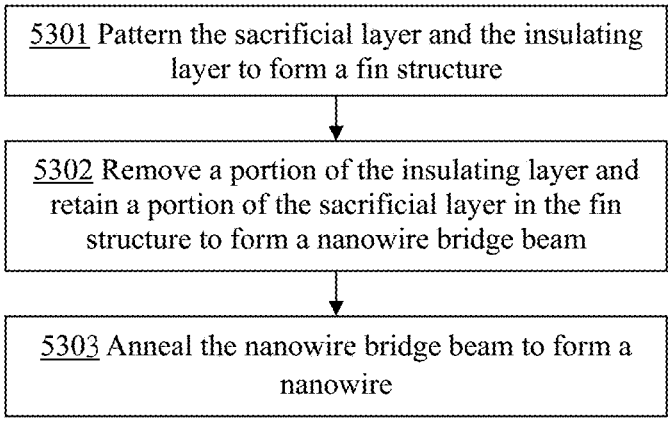
FIG. 5 shows a flowchart that illustrates a method for forming a nanowire in accordance with an embodiment of the present invention.

FIG. 5 shows a flowchart that illustrates a method for forming a nanowire in accordance with an embodiment of the present invention. Schematic cross-section views illustrating intermediate structures related to process steps in the method are shown in FIGS. 7A to 9B.

Figure 7A:
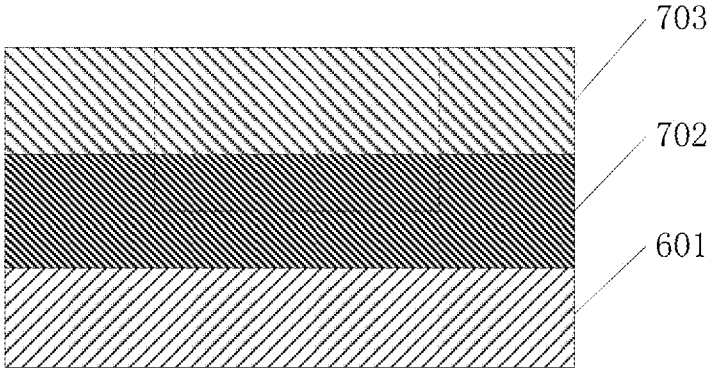
FIG. 7A shows a schematic cross-sectional view that illustrates a cross-section of a semiconductor device manufacturing intermediate structure viewed in a direction perpendicular to an extension direction of a fin structure in accordance with an embodiment of the present invention.
Figure 7B:
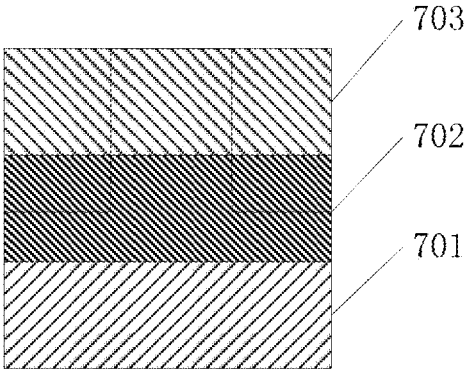
FIG. 7B shows a schematic cross-sectional view that illustrates a cross-section of a semiconductor device manufacturing intermediate structure viewed in an extension direction of a fin structure in accordance with an embodiment of the present invention.

FIG. 7A shows a schematic cross-sectional view that illustrates a cross-section of a semiconductor device manufacturing intermediate structure viewed in a direction perpendicular to an extension direction of a fin structure in accordance with an embodiment of the present invention. FIG. 7B shows a schematic cross-sectional view that illustrates a cross-section of the semiconductor device manufacturing intermediate structure viewed in the extension direction of the fin structure in accordance with an embodiment of the present invention.

Referring to FIG. 5, FIG. 6B, FIG. 7A, and FIG. 7B, the nanowire-forming method may include a step 5301, pattering (e.g., etching) the sacrificial layer 603 and the insulating material layer 602 to form the fin structure. As a result of the patterning, a sacrificial member 703 (a portion of the sacrificial layer 603) and an insulating material member 702 (a portion of the insulating material layer 602) may remain.

The fin structure may include a first portion of the sacrificial member 703 and a first portion of the insulating material member 702. The first portion of the sacrificial member 703 may be positioned between two other portions of the sacrificial member 703 in the extension direction of the fin structure. The first portion of the insulating material member 702 may directly contact the first portion of the sacrificial member 703 and may be positioned between the first portion of the sacrificial member 703 and a second portion of the insulating material member 702. The second portion of the insulating material member 702 may be wider than the first second portion of the insulating material member 702 and may be positioned between the first second portion of the insulating material member 702 and the semiconductor substrate 601.

Figure 8A:
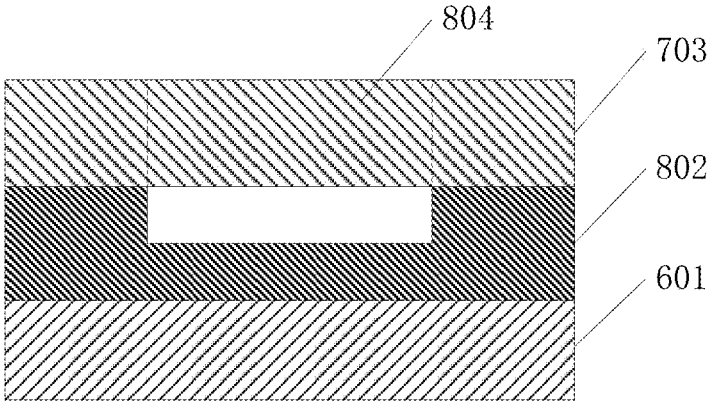
FIG. 8A shows a schematic cross-sectional view that illustrates a cross-section of a semiconductor device manufacturing intermediate structure viewed in a direction perpendicular to an extension direction of a rectangular-cuboid-shaped nanowire bridge beam in accordance with an embodiment of the present invention.
Figure 8B:
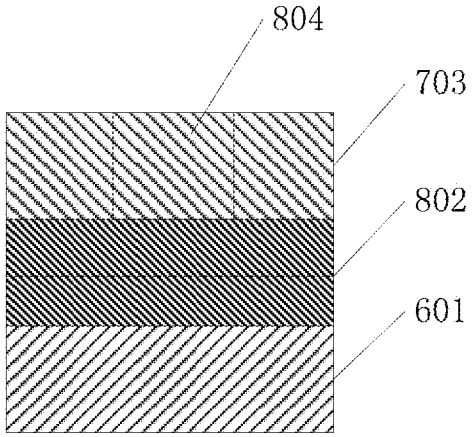
FIG. 8B shows a schematic cross-sectional view that illustrates a cross-section of a semiconductor device manufacturing intermediate structure viewed in an extension direction of a rectangular-cuboid-shaped nanowire bridge beam in accordance with an embodiment of the present invention.

FIG. 8A shows a schematic cross-sectional view that illustrates a cross-section of a semiconductor device manufacturing intermediate structure viewed in a direction perpendicular to an extension direction of a substantially rectangular-cuboid-shaped nanowire bridge beam 804 (which may have a substantially rectangular cross section) in accordance with an embodiment of the present invention. FIG. 8B shows a schematic cross-sectional view that illustrates a cross-section of the semiconductor device manufacturing intermediate structure viewed in the extension direction of the rectangular-cuboid-shaped nanowire bridge beam 804 in accordance with an embodiment of the present invention.

Referring to FIG. 5, FIG. 7A, FIG. 7B, FIG. 8A, and FIG. 8B, the nanowire-forming method may include a step 5302, removing the first portion of the insulating material member 702 and retaining the first portion of the sacrificial member 703 to form the rectangular-cuboid-shaped nanowire bridge beam 804. After the removal of the first portion of the insulating material member 702, an insulator 802 (another portion of the insulating material member 702) may remain on the semiconductor substrate 601. In an embodiment, the bridge beam 804 may have a frustum structure and/or a trapezoidal structure.

The first portion of the insulating material member 702 may be removed and/or the nanowire bridge beam 804 may be formed through one or more of a selective isotropic etching process, a selective lateral etching process, etc. using one or more etching solutions, such as one or more of BOE (buffered oxide etch solution), DHF (diluted hydrofluoric acid solution), etc.

Figure 9A:
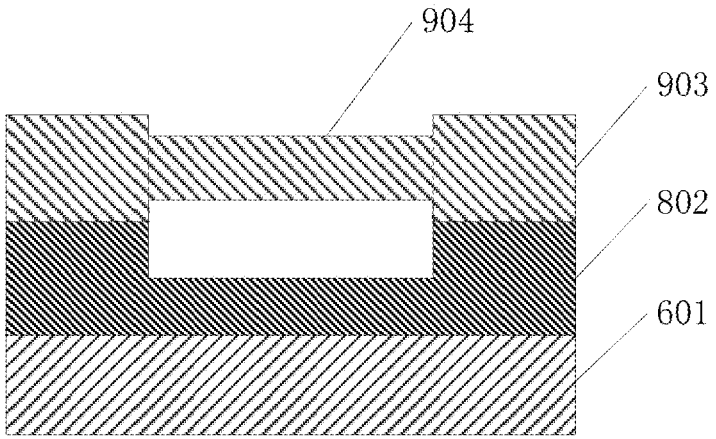
FIG. 9A shows a schematic cross-sectional view that illustrates a cross-section of a semiconductor device manufacturing intermediate structure viewed in a direction perpendicular to an extension direction of a (cylindrical) nanowire in accordance with an embodiment of the present invention.
Figure 9B:
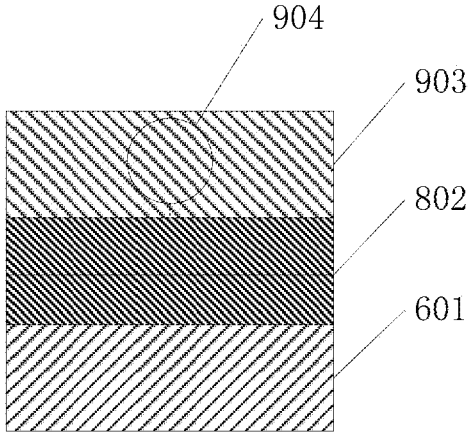
FIG. 9B shows a schematic cross-sectional view that illustrates a cross-section of a semiconductor device manufacturing intermediate structure viewed in an extension direction of a (cylindrical) nanowire in accordance with an embodiment of the present invention.

FIG. 9A shows a schematic cross-sectional view that illustrates a cross-section of a semiconductor device manufacturing intermediate structure viewed in a direction perpendicular to an extension direction of a (e.g., cylindrical) nanowire 904 in accordance with an embodiment of the present invention. FIG. 9B shows a schematic cross-sectional view that illustrates a cross-section of a semiconductor device manufacturing intermediate structure viewed in the extension direction of the (e.g., cylindrical) nanowire 904 in accordance with an embodiment of the present invention.

Referring to FIG. 5, FIG. 8A, FIG. 8B, FIG. 9A, and FIG. 9B, the nanowire-forming method may include a step 5303, performing annealing on the nanowire bridge beam 804 to form a nanowire 904. As result of annealing, a sacrificial unit 903 (a portion of the sacrificial member 703) may remain. The sacrificial unit 903 may include two end portions and the nanowire 904, wherein the nanowire 904 may be positioned between the two end portions of the sacrificial unit 903. The annealing may be performed in an environment of one or more of He, $N_2$, Ar, $H_2$, etc. The nanowire 904 may have one or more of a circular cylindrical structure, an oval cylindrical structure, a circular frustum structure, an oval frustum structure, a circular cone structure, etc. Cross-sections of the nanowire 904 viewed in the extension direction of the nanowire 904 may have one or more of a circular shape, an oval shape, etc., and may have one or more sizes.

Figure 10A:
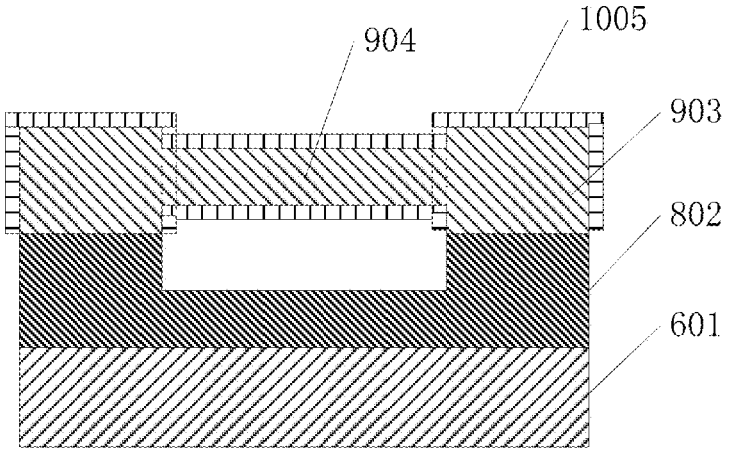
FIG. 10A shows a schematic cross-sectional view that illustrates a cross-section of a semiconductor device manufacturing intermediate structure that includes a dielectric material member viewed in a direction perpendicular to an extension direction of a nanowire in accordance with an embodiment of the present invention.
Figure 10B:
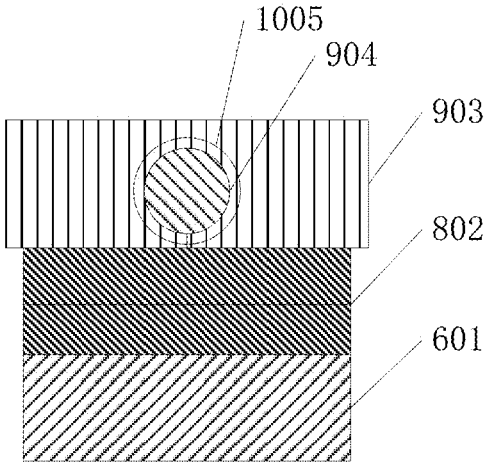
FIG. 10B shows a schematic cross-sectional view that illustrates a cross-section of a semiconductor device manufacturing intermediate structure that includes a dielectric material member viewed in an extension direction of a nanowire in accordance with an embodiment of the present invention.

FIG. 10A shows a schematic cross-sectional view that illustrates a cross-section of a semiconductor device manufacturing intermediate structure that includes a dielectric material member 1005 viewed in a direction perpendicular to an extension direction of the nanowire 904 in accordance with an embodiment of the present invention. FIG. 10B shows a schematic cross-sectional view that illustrates a cross-section of a semiconductor device manufacturing intermediate structure that includes the dielectric material member 1005 viewed in the extension direction of the nanowire in accordance with an embodiment of the present invention.

Referring to FIG. 3, FIG. 9A, FIG. 9B, FIG. 10A, and FIG. 10B, the semiconductor device manufacturing method may include a step 304, forming the dielectric material member 1005. The dielectric material member 1105 may substantially enclose material of the sacrificial unit 903. The dielectric material member 1005 may be formed at/on surfaces of the sacrificial unit 903.

In an embodiment, the dielectric material member 1005 may include and/or may be at least one of an oxide member (e.g., an $Al_2O_3$ member) and a nitride member (e.g., an AlN member) formed through applying plasma to the sacrificial unit 903. The plasma may include ions or one or more of $O_2$ (oxygen), $N_2O$ (nitrous oxide), and $NH_3$ (ammonia).

In an embodiment, the dielectric material member 1005 may include and/or may be at least one dielectric material (e.g., at least one of $Al_2O_3$, AlN, $SiO_2$, etc.) deposited on surfaces of the sacrificial unit 903 through at least one deposition method, such as ALD.

A thickness of the dielectric material member 1005 may be in a range of 1 nm to 10 nm. According to embodiments, a thickness of the dielectric material member 1005 may be less than 1 nm or greater than 10 nm.

Figure 11A:
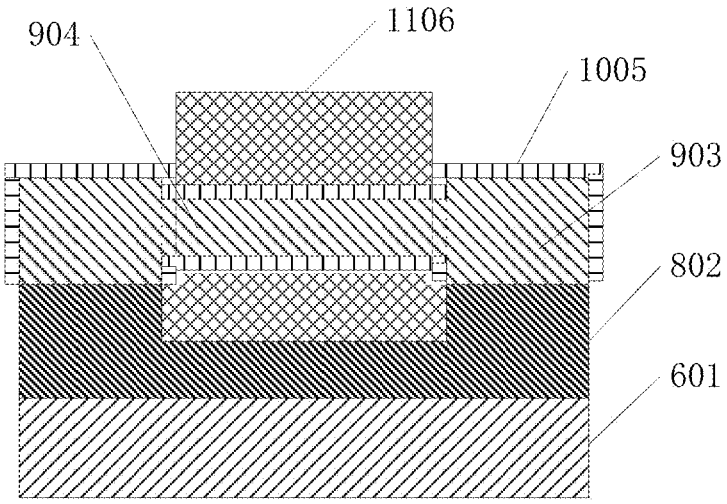
FIG. 11A shows a schematic cross-sectional view that illustrates a cross-section of a semiconductor device manufacturing intermediate structure that includes a wraparound gate electrode viewed in a direction perpendicular to an extension direction of a nanowire in accordance with an embodiment of the present invention.
Figure 11B:
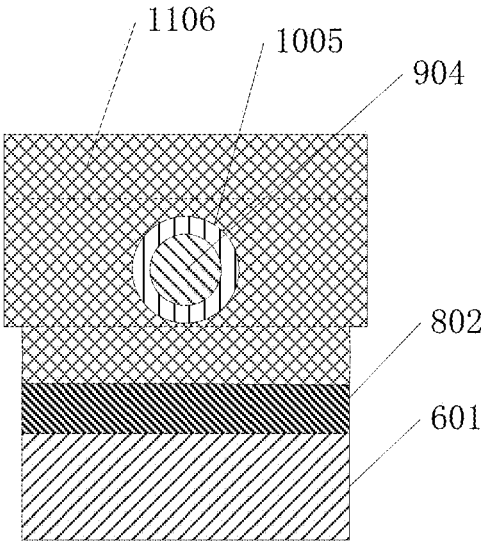
FIG. 11B shows a schematic cross-sectional view that illustrates a cross-section of a semiconductor device manufacturing intermediate structure that includes a wraparound gate electrode viewed in an extension direction of a nanowire in accordance with an embodiment of the present invention.

FIG. 11A shows a schematic cross-sectional view that illustrates a cross-section of a semiconductor device manufacturing intermediate structure that includes a wraparound gate electrode 1106 viewed in a direction perpendicular to an extension direction of a nanowire 904 in accordance with an embodiment of the present invention. FIG. 11B shows a schematic cross-sectional view that illustrates a cross-section of the semiconductor device manufacturing intermediate structure that includes the wraparound gate electrode 1106 viewed in the extension direction of the nanowire 904 in accordance with an embodiment of the present invention.

Referring to FIG. 3, FIG. 10A, FIG. 10B, FIG. 11A, and FIG. 11B, the semiconductor device manufacturing method may include a step 305, forming the wraparound gate electrode 1106 (or gate 1106). The gate 1106 may substantially surround a portion of the dielectric material member 1005 that substantially surrounds the nanowire 904. The gate 1106 may be formed of at least one of the following conductive materials: Cr, W, Co, Pd, Cu, Al, Ti, TiN, Ta, TaN, Au, Ag, and Pt. The gate 1106 may be formed through one or more of the following steps: depositing at least one suitable conductive material on the portion of the dielectric material member 1005 using at least one deposition method, such as at least one of CVD, MOCVD (metal organic chemical vapor deposition), and ALD; and pattering the deposited conductive material using at least one patterning method, such as one or more of photolithography, dry etching, and lift-off. In an embodiment, the gate 1106 may be formed through both photolithography and dry etching. In an embodiment, the gate 1106 may be formed through a lift-off process that does not involve photolithography or dry etching.

Figure 12A:
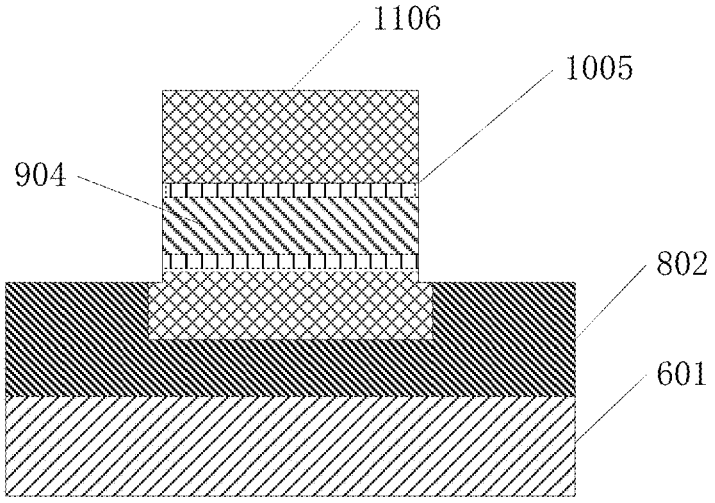
FIG. 12A shows a schematic cross-sectional view that illustrates a cross-section of a semiconductor device manufacturing intermediate structure after removal of a dielectric material member and sacrificial unit viewed in a direction perpendicular to an extension direction of a nanowire in accordance with an embodiment of the present invention.
Figure 12B:
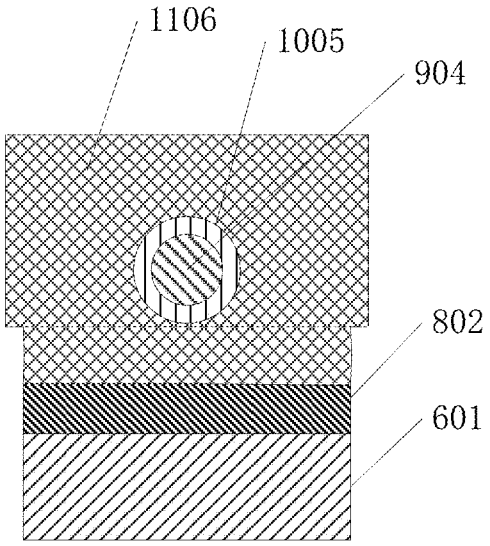
FIG. 12B shows a schematic cross-sectional view that illustrates a cross-section of a semiconductor device manufacturing intermediate structure after partial removal of a dielectric material member and sacrificial unit viewed in an extension direction of a nanowire in accordance with an embodiment of the present invention.
Figure 13A:
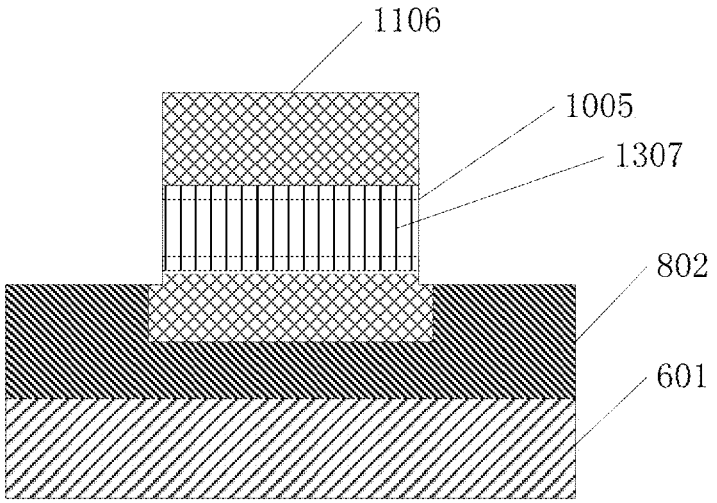
FIG. 13A shows a schematic cross-sectional view that illustrates a cross-section of a semiconductor device manufacturing intermediate structure that has a hollow channel viewed in a direction perpendicular to an extension direction of the hollow channel in accordance with an embodiment of the present invention.
Figure 13B:
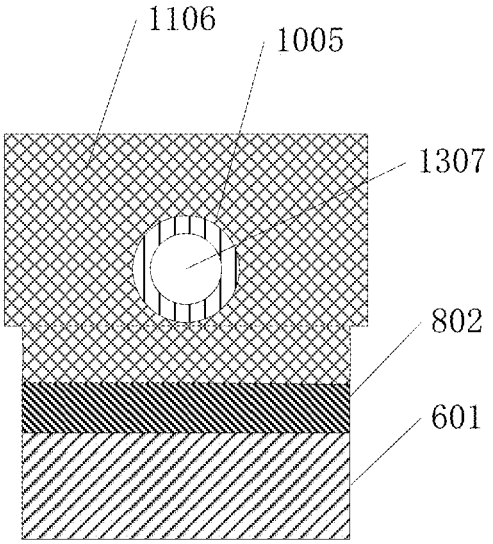
FIG. 13B shows a schematic cross-sectional view that illustrates a cross-section of a semiconductor device manufacturing intermediate structure that has a hollow channel viewed in an extension direction of the hollow channel in accordance with an embodiment of the present invention.

FIG. 12A shows a schematic cross-sectional view that illustrates a cross-section of a semiconductor device manufacturing intermediate structure after partial removal of a dielectric material member 1005 and a sacrificial unit 903 (e.g., illustrated in FIG. 11A) viewed in a direction perpendicular to an extension direction of a nanowire 904 in accordance with an embodiment of the present invention. FIG. 12B shows a schematic cross-sectional view that illustrates a cross-section of the semiconductor device manufacturing intermediate structure after partial removal of the dielectric material member 1005 and the sacrificial unit 903 (e.g., illustrated in FIG. 11B) viewed in the extension direction of the nanowire 904 in accordance with an embodiment of the present invention. FIG. 13A shows a schematic cross-sectional view that illustrates a cross-section of a semiconductor device manufacturing intermediate structure that has a hollow channel 1307 viewed in a direction perpendicular to an extension direction of the hollow channel 1307 in accordance with an embodiment of the present invention. FIG. 13B shows a schematic cross-sectional view that illustrates a cross-section of the semiconductor device manufacturing intermediate structure that has the hollow channel 1307 viewed in the extension direction of the hollow channel 1307 in accordance with an embodiment of the present invention.

Referring to FIG. 3, FIG. 11A, FIG. 11B, FIG. 12A, FIG. 12B, FIG. 13A, and FIG. 13B, the semiconductor device manufacturing method may include a step 306, removing two end portions of the dielectric material member 1105 that are positioned at two ends of the gate 1106, removing two end portions of the sacrificial unit 903 that are positioned at the two ends of the gate 1106, and removing the nanowire 904 (which is surrounded by the gate 1106). As a result, the hollow channel 1307 may be formed.

The two end portions of the dielectric material member 1105 and/or the two end portions of the sacrificial unit 903 may be removed through one or more of photolithography, etching, etc.

The nanowire 904 may be removed through selective wet etching and/or one or more other material processes.

The hollow channel 1307 may contain one or more inert gases (e.g., He) or may contain a substantially vacuum space. The substantially vacuum space in the hollow channel 1307 may facilitate transmission of electrons. The substantially vacuum space in the hollow channel 1307 may be implemented by placing the hollow channel 1307 or a semiconductor device structure with the hollow channel 1307 in a sealed chamber and then extracting air and/or gases from the hollow channel 1307 using one or more of a molecular pump, a mechanical pump, etc.

The hollow channel 1307 may have one or more of a circular cylindrical structure, an oval cylindrical structure, a circular frustum structure, an oval frustum structure, a circular cone structure, etc. Cross-sections of the hollow channel 1307 viewed in an extension direction of the hollow channel 1307 may have one or more of a circular shape, an oval shape, etc., and may have one or more sizes.

Figure 14A:
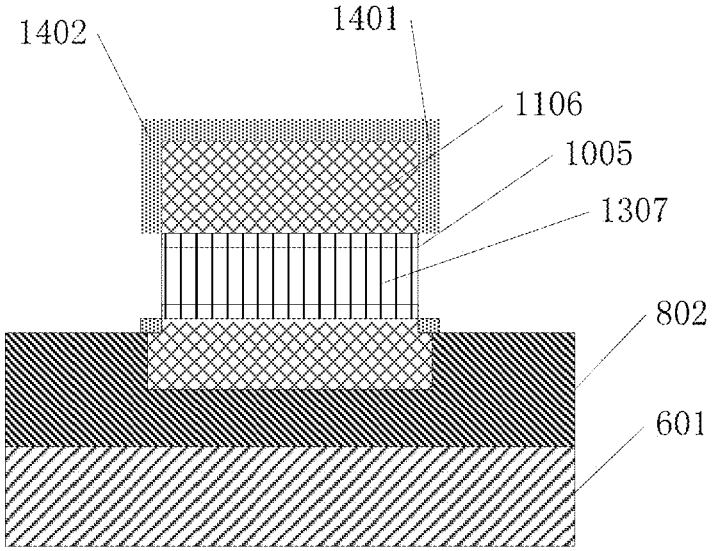
FIG. 14A shows a schematic cross-sectional view that illustrates a cross-section of a semiconductor device manufacturing intermediate structure that includes an insulator disposed on a gate electrode viewed in a direction perpendicular to an extension direction of a hollow channel in accordance with an embodiment of the present invention.
Figure 14B:
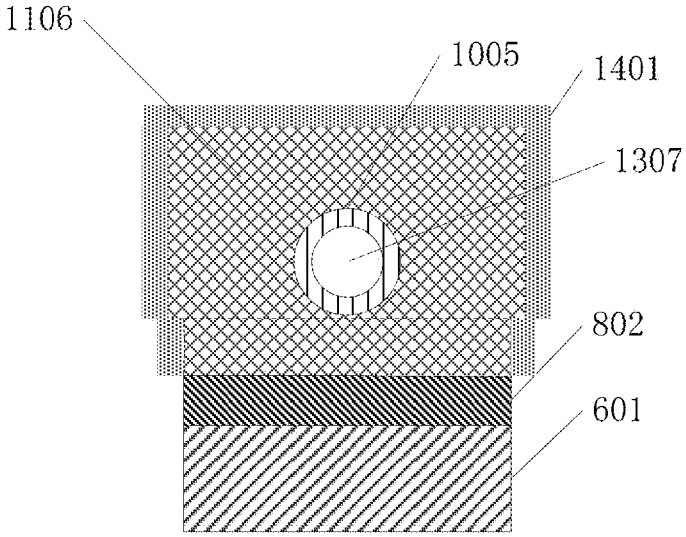
FIG. 14B shows a schematic cross-sectional view that illustrates a cross-section of a semiconductor device manufacturing intermediate structure that includes an insulator disposed on a gate electrode viewed in an extension direction of a hollow channel in accordance with an embodiment of the present invention.

FIG. 14A shows a schematic cross-sectional view that illustrates a cross-section of a semiconductor device manufacturing intermediate structure that includes an insulator disposed on a gate 1106 viewed in a direction perpendicular to an extension direction of a hollow channel 1307 in accordance with an embodiment of the present invention. FIG. 14B shows a schematic cross-sectional view that illustrates a cross-section of the semiconductor device manufacturing intermediate structure that includes the insulator disposed on the gate 1106 viewed in the extension direction of the hollow channel 1307 in accordance with an embodiment of the present invention.

Referring to FIG. 3, FIG. 13A, FIG. 13B, FIG. 14A, and FIG. 14B, the semiconductor device manufacturing method may include a step 307, forming the insulator at/on the gate 1106. The insulator may include a first insulating member 1401 and a second insulating member 1402 that may be respectively positioned at two ends of the gate 1106.

In an embodiment, each of the first insulating member 1401 and the second insulating member 1402 may include and/or may be at least one of an oxide member (e.g., an $Al_2O_3$ member) and a nitride member (e.g., an AlN member) formed through applying plasma to the gate 1106. The plasma may include ions or one or more of $O_2$ (oxygen), $N_2O$ (nitrous oxide), and $NH_3$ (ammonia).

In an embodiment, each of the first insulating member 1401 and the second insulating member 1402 may include and/or may be at least one dielectric material (e.g., at least one of $Al_2O_3$, AlN, $SiO_2$, etc.) deposited on the gate 1106 through at least one deposition method, such as ALD.

Referring to FIG. 3, FIG. 14A, FIG. 14B, FIG. 1A, and FIG. 1B, the semiconductor device manufacturing method may include a step 308, forming a source electrode 1601 (or source 1601) and a drain electrode 1602 (or drain 1602) at two ends of the hollow channel 1307, such that the hollow channel 1307 may be sealed between the source 1601 and the drain 1602. The pressure inside the hollow channel 1307 may be in a range of 0.001 torr to 50 torr. The distance between the source 1601 and the drain 1602 may be in a range of several nanometers to several hundred nanometers. The distance may be less than 10 nm. The distance may be less than a mean free path of electrons in the air.

The source 1601 and/or the drain 1602 may be formed of at least one of the following conductive materials: Cr, W, Co, Pd, Cu, Al, Ti, TiN, Ta, TaN, Au, Ag, Pt, etc. The source 1601 and/or the drain 1602 may be formed through one or more of the following steps: depositing at least one suitable conductive material on the portion of the dielectric material member 1005 using at least one deposition method, such as at least one of CVD, MOCVD, and ALD; and pattering the deposited conductive material using at least one patterning method, such as one or more of photolithography, dry etching, and lift-off. In an embodiment, the source 1601 and/or the drain 1602 may be formed through both photolithography and dry etching. In an embodiment, the source 1601 and/or the drain 1602 may be formed through a lift-off process that does not involve photolithography or dry etching.

Figure 4:
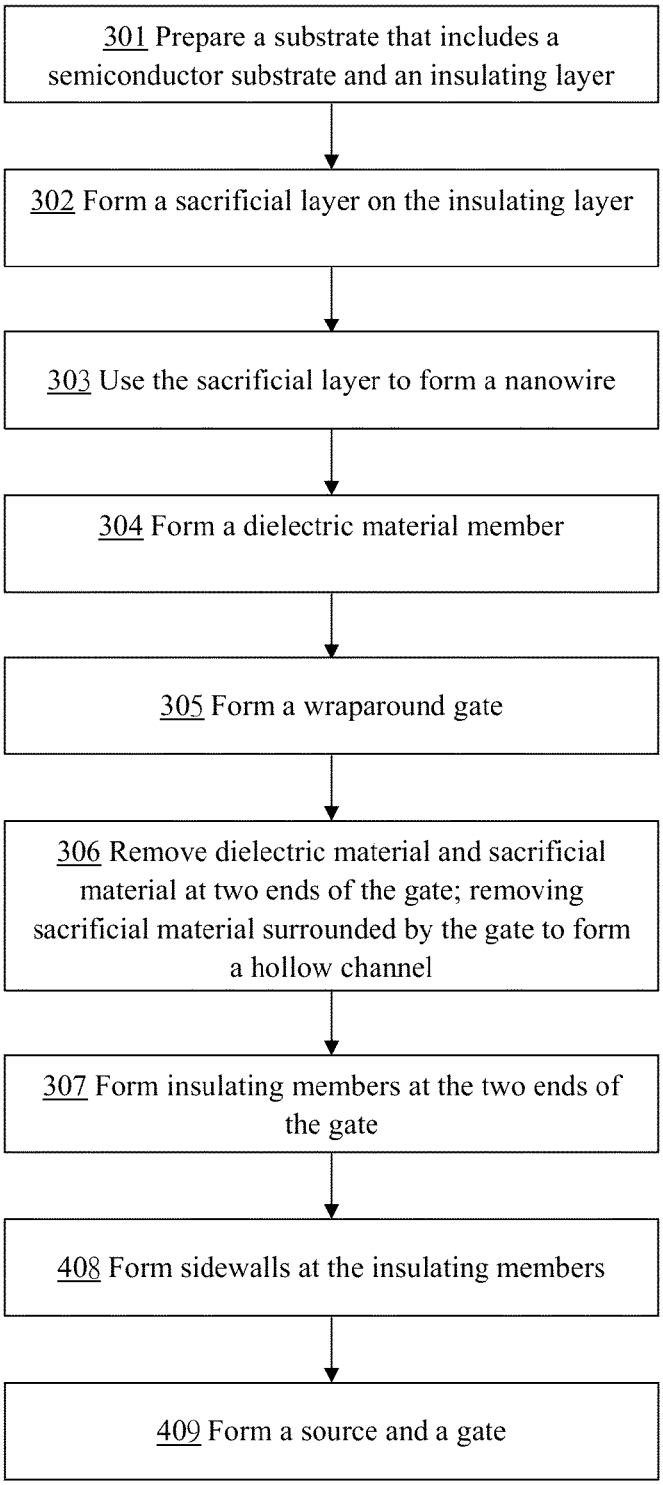
FIG. 4 shows a flowchart that illustrates a method for manufacturing a semiconductor device in accordance with an embodiment of the present invention.

FIG. 4 shows a flowchart that illustrates a method for manufacturing a semiconductor device in accordance with an embodiment of the present invention. The method may include the steps 301 to 307 discussed with reference to FIG. 3 to FIG. 14B.

Figure 15A:
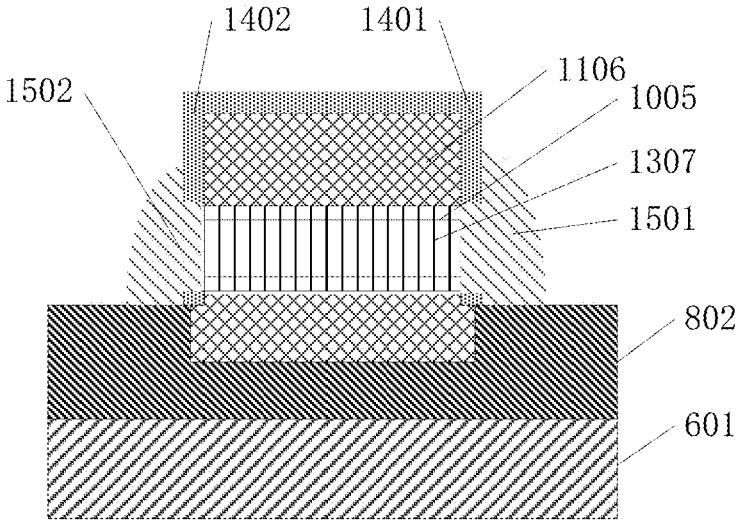
FIG. 15A shows a schematic cross-sectional view that illustrates a cross-section of a semiconductor device manufacturing intermediate structure that includes sidewalls disposed at two ends of a hollow channel viewed in a direction perpendicular to an extension direction of the hollow channel in accordance with an embodiment of the present invention.
Figure 15B:
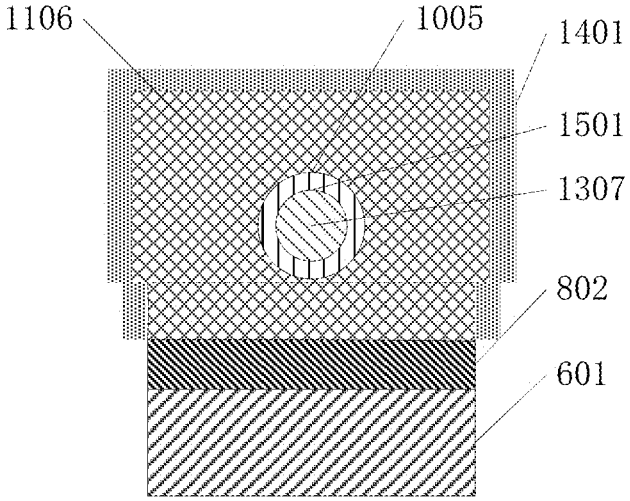
FIG. 15B shows a schematic cross-sectional view that illustrates a cross-section of a semiconductor device manufacturing intermediate structure that includes sidewalls disposed at two ends of a hollow channel viewed in an extension direction of the hollow channel in accordance with an embodiment of the present invention.

FIG. 15A shows a schematic cross-sectional view that illustrates a cross-section of a semiconductor device manufacturing intermediate structure that includes a first sidewall 1501 and a second sidewall 1502 disposed at two ends of a hollow channel 1307 viewed in a direction perpendicular to an extension direction of the hollow channel 1307 in accordance with an embodiment of the present invention. FIG. 15B shows a schematic cross-sectional view that illustrates a cross-section of the semiconductor device manufacturing intermediate structure that includes the sidewalls 1501 and 1502 disposed at the two ends of the hollow channel 1307 viewed in the extension direction of the hollow channel 1307 in accordance with an embodiment of the present invention.

Referring to FIG. 4, FIG. 14A, FIG. 14B, FIG. 15A, and FIG. 15B, the method may further include a step 408, forming the first sidewall 1501 and the second sidewall 1502 at the first insulating member 1401 and the second insulating member 1402, respectively. The first sidewall 1501 and the second sidewall 1502 may be formed at two ends the hollow channel 1307 and may seal the hollow channel 1307.

At least one of the first sidewall 1501 and the second sidewall 1502 may be made of a low work function material, which may facilitate transmission and reception of electrons. The work function of the low work function material may be less than 6 eV. The low work function material may include at least one of Zr, V, Nb, Ta, Cr, Mo, W, Fe, Co, Pd, Cu, Al, Ga, In, Ti, TiN, TaN, diamond, etc.

The sidewalls 1501 and 1502 may be formed through one or more of the following steps: depositing at least one suitable low work function material on the insulator 802 using at least one deposition process, such as at least one of PVD, CVD, etc.; and performing an anisotropic etching on the deposited low work function material to form the sidewalls 1501 and 1502.

Figure 16A:
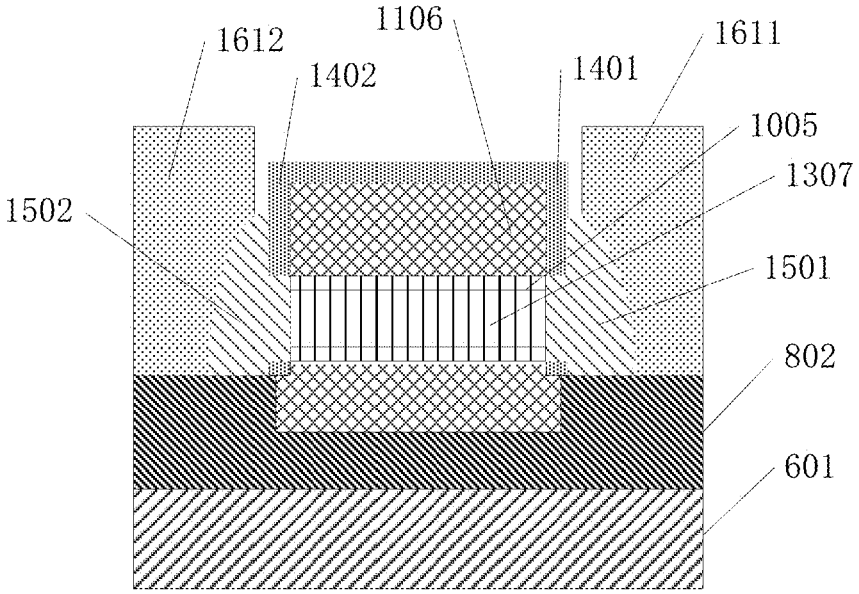
FIG. 16A shows a schematic cross-sectional view that illustrates a cross-section of a semiconductor device structure that includes a source electrode and a drain electrode viewed in a direction perpendicular to an extension direction of a hollow channel in accordance with an embodiment of the present invention.
Figure 16B:
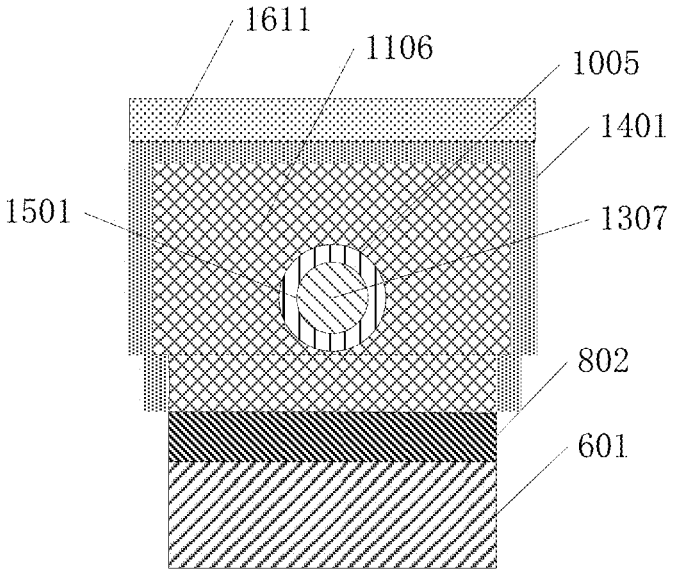
FIG. 16B shows a schematic cross-sectional view that illustrates a cross-section of a semiconductor device structure that includes a source electrode and a drain electrode viewed in an extension direction of a hollow channel in accordance with an embodiment of the present invention.

FIG. 16A shows a schematic cross-sectional view that illustrates a cross-section of a semiconductor device structure that includes a source electrode 1611 (or source 1611) and a drain electrode 1602 (or drain 1612) viewed in a direction perpendicular to an extension direction of a hollow channel 1307 in accordance with an embodiment of the present invention. FIG. 16B shows a schematic cross-sectional view that illustrates a cross-section of the semiconductor device structure that includes the source 1611 and the drain 1612 viewed in the extension direction of the hollow channel 1307 in accordance with an embodiment of the present invention.

Referring to FIG. 4, FIG. 15A, FIG. 15B, FIG. 16A, and FIG. 16B, the method may further include a step 409, forming the source 1611 and the drain 1612 on the first sidewall 1501 and the second sidewall 1502, respectively. A portion of the first sidewall 1501 may be positioned between the first insulating member 1401 and the source 1611. A portion of the second sidewall 1502 may be positioned between the second insulating member 1402 and the drain 1612. The source 1611 and the drain 1612 may be formed using one or more processes and/or one or more materials that may be analogous to or identical to one or more processes and/or one or more materials related to the step 308 discussed with reference to FIG. 3, FIG. 1A, and FIG. 1B.

In an embodiment, an annealing process may be performed on the first sidewall 1501 and the second sidewall 1502 (and/or a structure that includes the sidewalls), such that each of the first sidewall 1501 and the second sidewall 1502 may have a curved surface (e.g., an arcuate surface) that may be convex toward the hollow channel 1307. The curved surface may minimize potential acute angle effects to prevent the source 1611 from being burned. The curved surface(s) may provide a substantially large electron transmission area and/or a substantially large electron reception area, such that the effectiveness and/or efficiency of the semiconductor device may be advantageously maximized. The annealing may be performed in an environment (or atmosphere) of one or more of $N_2$, $H_2$, etc. The annealing may be performed in a temperature in a range of 600° C. to 1300° C. and/or performed about/at the melting point of the low work function material (which may be in the range of 600° C. to 1300° C.). In particular embodiments, the annealing temperature may be higher or lower than this range.

While this invention has been described in terms of several embodiments, there are alterations, permutations, and equivalents, which fall within the scope of this invention. It should also be noted that there are many alternative ways of implementing the methods and apparatuses of the present invention. Furthermore, embodiments of the present invention may find utility in other applications. The abstract section is provided herein for convenience and, due to word count limitation, is accordingly written for reading convenience and should not be employed to limit the scope of the claims. It is therefore intended that the following appended claims be interpreted as including all such alterations, permutations, and equivalents as fall within the true spirit and scope of the present invention.

What is claimed is:

1. A method for manufacturing a semiconductor device, the method comprising:

preparing a substrate structure that includes a semiconductor substrate and an insulating layer;

forming a sacrificial layer on the insulating layer;

using the sacrificial layer to form a wire;

forming a dielectric member that surrounds the wire;

forming a gate electrode that surrounds the dielectric member;

removing the wire for forming a hollow channel that is surrounded by the gate electrode;

forming a first insulating member and a second insulating member;

forming a source electrode such that the first insulating member is positioned between the gate electrode and the source electrode; and forming a drain electrode such that the second insulating member is positioned between the gate electrode and the drain electrode.

2. The method of claim 1, further comprising:

removing two portions of a dielectric layer that are located at two ends of the gate electrode for forming the dielectric member; and removing two portions of the sacrificial layer that are located at the two ends of the gate electrode for forming the wire.

3. The method of claim 1, further comprising:

forming a first sidewall at the first insulating member before the forming the source electrode, wherein a portion of the first sidewall is positioned between the first insulating member and the source electrode after the forming the source electrode; and forming a second sidewall at the second insulating member before the forming the drain electrode, wherein a portion of the second sidewall is positioned between the second insulating member and the drain electrode after the forming the drain electrode.

4. The method of claim 3, wherein at least one of the first sidewall and the second sidewall is formed of a low work function material.

5. The method of claim 4, wherein the annealing is performed at a temperature that is in a range of 600° C. to 1300° C.

6. The method of claim 3, further comprising: performing annealing using an atmosphere that includes at least one of $H_2$ and $N_2$ such that at least one of the first sidewall and the second sidewall includes a curved surface that is convex toward the hollow channel.

7. The method of claim 1, further comprising: at least one of providing an inert gas in the hollow channel and evacuating the hollow channel.

8. The method of claim 1, wherein the hollow channel has at least one of a circular cylindrical structure, an oval cylindrical structure, a circular frustum structure, an oval frustum structure, a circular cone structure.

9. The method of claim 1, further comprising:

patterning the sacrificial layer and the insulating layer to form a fin structure that includes a portion of the sacrificial layer and a portion of the insulating layer;

removing the portion of the insulating layer; and performing annealing on the portion of the sacrificial layer to form the wire.

10. The method of claim 9, wherein the annealing is performed using an atmosphere that includes at least one of He, $N_2$, Ar, and $H_2$.

11. The method of claim 9, wherein the removing the portion of the insulating layer includes etching the portion of the insulating layer using at least one of a buffered oxide etch solution and a diluted hydrofluoric acid solution.

12. The method of claim 1, wherein the sacrificial layer is formed of at least one of Al, polycrystalline silicon, Cr, Mo, W, Fe, Co, Cu, Ga, In, and Ti.

* * * * *